US005613757A

United States Patent [19]

Polk

[11] Patent Number: 5,613,757

[45] Date of Patent: Mar. 25, 1997

[54] CANOPY FOR CREATING NIGHT SKY IMAGE

[76] Inventor: Bryan T. Polk, 6686 Finch Rd., Memphis, Tenn. 38141

[21] Appl. No.: 311,929

[22] Filed: Sep. 26, 1994

[51] Int. Cl.[6] ..... A47B 23/06

[52] U.S. Cl. ..... 362/130; 362/801; 362/806; 362/807; D6/389

[58] Field of Search ..... 362/121, 124, 362/130, 223, 253, 801, 806, 807, 811, 809; D6/388, 389; 5/DIG. 905, 414

[56] References Cited

U.S. PATENT DOCUMENTS

| | | | |
|---|---|---|---|
| D. 250,687 | 1/1979 | Robelen . | |
| 654,972 | 7/1900 | Haack | 5/414 |
| 2,821,621 | 1/1958 | Allunario | 362/124 |
| 2,993,216 | 7/1961 | Casey | 5/905 |
| 4,607,401 | 8/1986 | Sisson . | |
| 4,641,387 | 2/1987 | Bondy et al. . | |
| 4,729,137 | 3/1988 | Denney . | |
| 4,903,353 | 2/1990 | Park | 5/905 |
| 4,945,586 | 8/1990 | Cross et al. | 5/414 |

*Primary Examiner*—Y. My Quach

*Attorney, Agent, or Firm*—Baker, Donelson, Bearman & Caldwell

[57] ABSTRACT

Canopy apparatus for use with a bed, for creating the visual impression of a star-lit sky. In a preferred embodiment, the canopy comprises a frame suspendable above a bed, at least one light fixture disposed within the frame for generating light, and a screen having a plurality of openings formed therein suspended by the frame beneath the light fixture. Light passing from the fixture through the openings creates the appearance of a plurality of stars and a moon for the user reclining on a bed beneath the canopy.

16 Claims, 2 Drawing Sheets

CANOPY FOR CREATING NIGHT SKY IMAGE

BACKGROUND OF THE INVENTION

1. Field

This invention relates to bed canopies and, more particularly, to a canopy having a light fixture disposed therein and a screen for creating the image of a star-lit sky.

2. Description of the Prior Art

Bed canopies are typically employed for decorative and aesthetic purposes, performing little or no useful function. Conventional canopies, as a rule, do not significantly improve the utility of a bed as a sleeping environment. Several attempts have been made to devise a canopy or other enclosure for changing the basic character of the bed, making it more suitable for uses other than sleeping, per se. Examples of such efforts are shown in the following U.S. patents: U.S. Pat. No. 4,641,387 issued Feb. 10, 1987 to Bondy et al., entitled "Bed Enclosure"; U.S. Pat. No. 4,607,401 issued Aug. 26, 1986 to Sisson, entitled "Mirrored Bed Canopy"; U.S. 4,945,586 issued Aug. 7, 1990 to Cross et al., et al. entitled "Canopy Bed Frame Assembly"; and U.S. Pat. No. Design 250,687 issued Jan. 2, 1979 to Robelen, entitled "Bed Canopy".

None of the above cited prior art references discloses a bed canopy which creates an environment adapted to assist the user in falling asleep. In particular, the prior art does not disclose a bed canopy which creates the soothing and relaxing appearance of a star-lit sky to lull the user to sleep. Accordingly, a need has been recognized for such an apparatus.

BRIEF SUMMARY OF THE INVENTION

It is an object of the present invention to provide a bed canopy which creates a visual environment conducive to sleeping.

Another object is to provide a bed canopy adapted to create the visual appearance of a star-lit sky.

In order to achieve these and other objects, this invention comprises a canopy apparatus for use with the bed, having a frame suspendable above the bed, a plurality of light bulbs disposed within the frame, and a screen having a plurality of openings formed therein suspended by the frame beneath the light bulbs, wherein the screen is operative to at least partially restrict the passage of light from the bulbs to the bed, with the openings allowing light to pass therethrough in a manner creating the appearance of the sky at night. In the preferred embodiment of this invention, one of the openings is in the shape of the moon, while a plurality of the openings create the appearance of stars. Preferably, fluorescent lamps are used to provide light, and a curtain suspended from the frame surrounds the bed to restrict the inward passage of extraneous light to the bed and the user asleep thereon. A conventional switch is mounted in the vicinity of the headboard to enable the user to control the lights as desired. It is also contemplated that a fan may be included in the canopy to provide fresh air to the user, and a stereo may be incorporated to provide music or soothing sounds to assist in sleep.

The above stated and other objects of this invention will become apparent to those skilled in the art upon reading the following detailed description in conjunction with the appended drawing figures.

DETAILED DESCRIPTION OF THE PREFERRED EMBODIMENT

Figure 1:
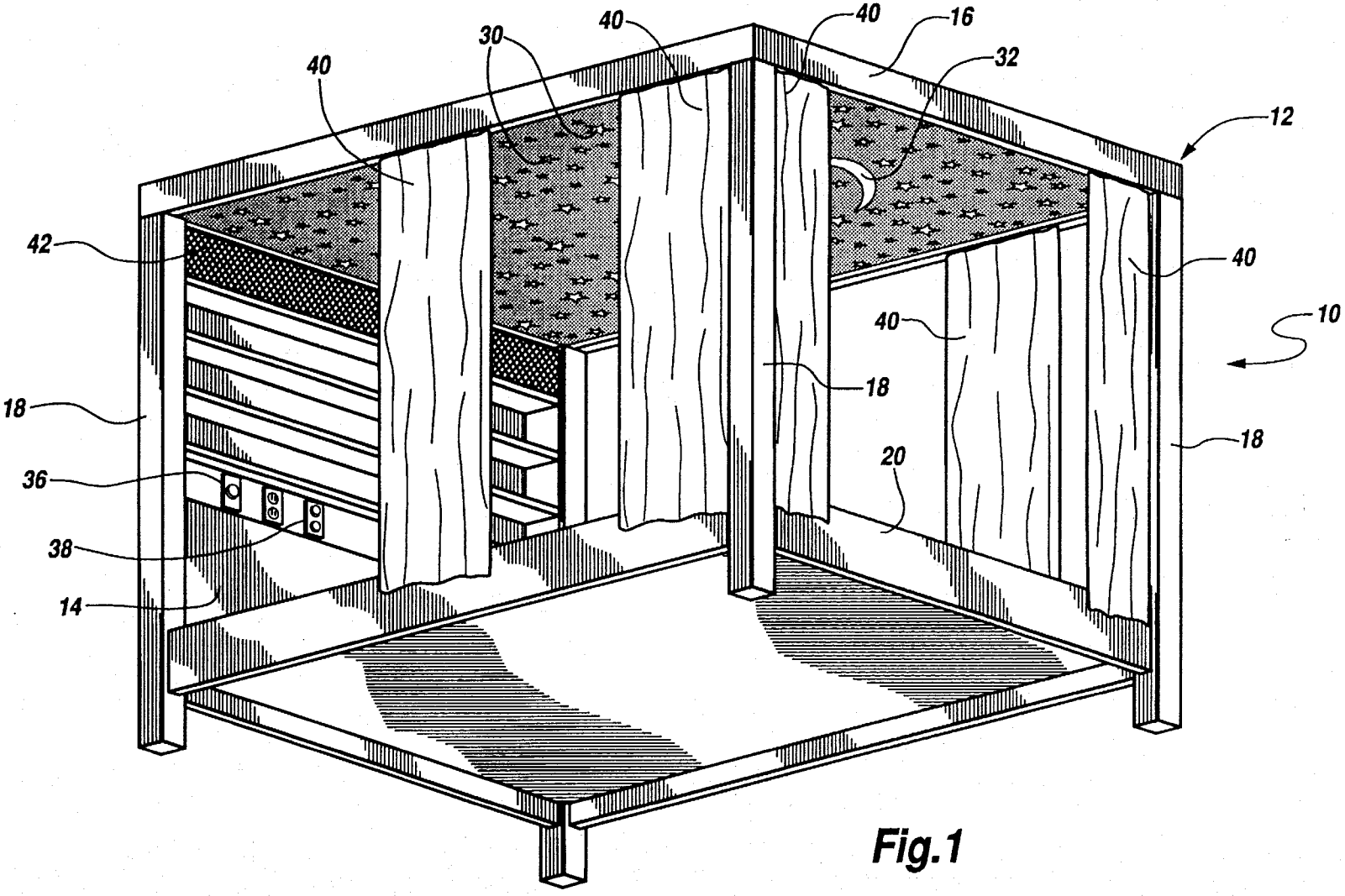
FIG. 1 is a bottom, side perspective view of a bed incorporating the canopy of the present invention.

Referring initially to FIG. 1, bed 10 is shown having canopy 12 installed thereon. It is to be understood that, with the exception of canopy 12 as described in detail hereinbelow, bed 10 is largely conventional. The principles of the present invention are embodied in canopy 12 and, to a lesser extent, headboard 14.

Figure 2:
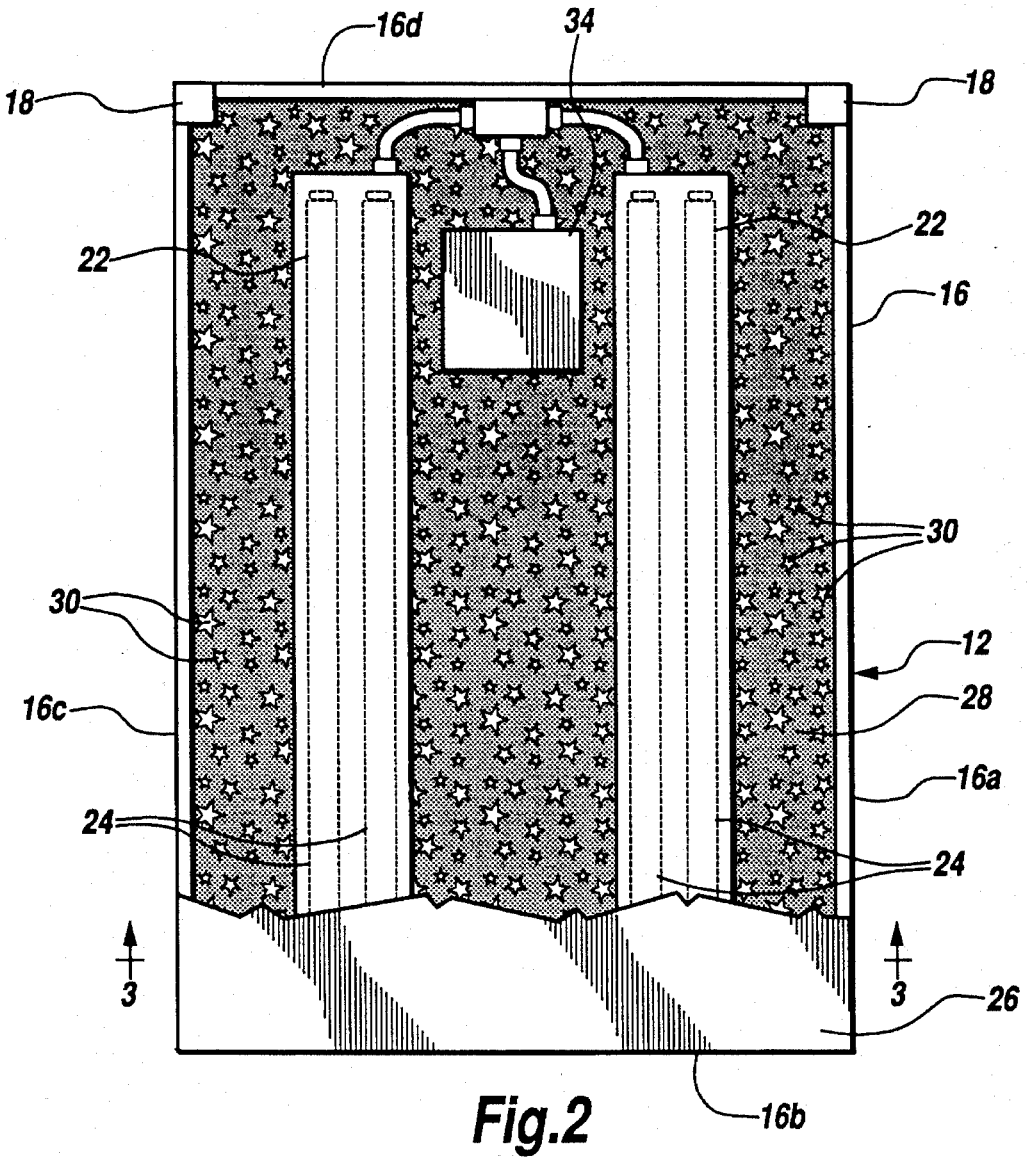
FIG. 2 is a top plan view of the canopy, with the top cover partially removed for clarity.

With reference now to FIGS. 1 and 2, canopy 12 comprises a rectangular frame 16, having four sides **16*a*, 16*b*, 16*c*, and 16*d*, joined at corner support posts 18. Frame 16 may be formed from wood, metal, plastic, or any other conventional material suitable for the purpose. Similarly, support posts 18 are preferably formed from wood, but may be made of any other suitable material, and are of a sufficient length to suspend canopy 12 an acceptable distance above mattress frame 20**.

Figure 3:
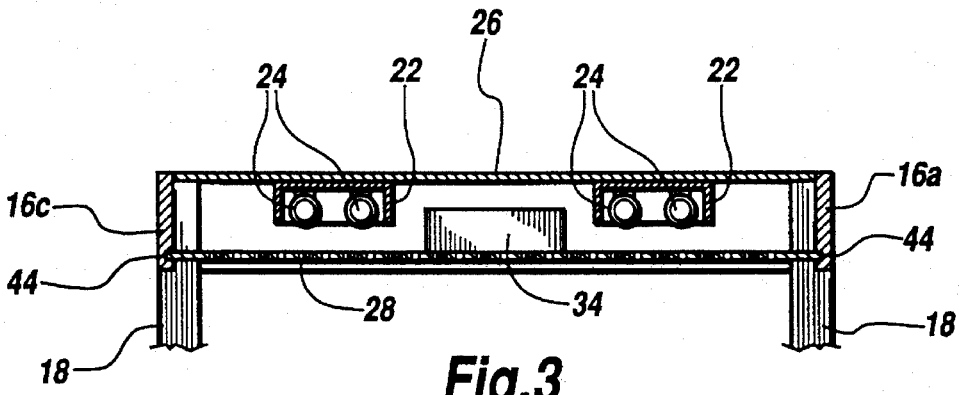
FIG. 3 is a sectional view through the canopy taken along lines 3—3 of FIG. 2.

As best seen in FIGS. 2 and 3, light fixtures 22 are disposed within frame 16, with each fixture 22 preferably including a pair of fluorescent lamps 24. Fixtures 22 may be secured to cover 26, as shown in FIG. 3, which prevents light generated by fixtures 24 from escaping upward through the top portion of frame 16.

A screen 28 is suspended within frame 16 beneath fixtures 22. A multitude of star-shaped openings 30 and a single moon-shaped opening 32 (seen in FIG. 1) are included in screen 28 to allow a portion of the light generated by fixtures 22 to pass therethrough, the remainder of screen 28 being essentially opaque. Openings 30 and 32 may be apertures, or may be translucent sections of screen 28, composed of the same material as screen 28 but untinted, or may be made of some other material suitable for the purpose. Light from fixtures 22 passing through openings 30 and 32 create the impression of a star-lit sky to a person reclining on bed 10. It is to be understood that the size and shape of openings 30 depicted in the enclosed drawing figures may be altered as desired to vary the visual effect created thereby. In particular, it is expected that openings 30 may be considerably smaller than shown, the attached drawing figures being exaggerated for purposes of clarity. It is also contemplated that openings 30 may be round holes, rather than star-shaped, for optimum visual effect.

In the preferred embodiment shown, a separate light fixture 34 such as an incandescent lamp is included, disposed immediately above moon-shaped opening 32. Accordingly, the user of canopy 12 may include or omit the moon, as desired. Generally conventional switches 36 and 38 are mounted on headboard 14 in a convenient location for the user, allowing selective control of light fixtures 22 and 34 (i.e., a means for automatically dimming the light generated thereby) so that the visual effect provided by canopy 12 may be altered as desired. Switches 36 and 38 are connected to fixtures 22 and 34 by conventional electrical wiring means which will be readily known to those skilled in the art. A plurality of curtains 40 may also be included, secured to frame 16. The user of bed 10 may close curtains 40 to prevent the intrusion of extraneous light which would diminish the visual effect provided by canopy 12, and to provide additional privacy. Finally, it is expected that a stereo or similar audio system may be installed within compartment 42 to provide soothing sounds to complement the visual effect of a star-lit sky, thereby further assisting the user in relaxing or sleeping.

As seen in FIG. 3, the outer edges of screen 28 are supported by a channel formed in frame 16, consisting of aligned slots 44 formed in walls 16*a*–16*d*. It is expected that, in one embodiment of this invention, wall 16*b* may be removable to provide access to screen 28, which may be slid out of place and replaced with one of a variety of additional screens having various visual images imprinted thereon. The user of bed 10 may then vary the visual image created by canopy 12 by selecting a screen according to his or her mood.

While the principles of a bed canopy producing the image of a star-lit sky have been made clear from the foregoing disclosure, it is fully expected that those skilled in the art will recognize numerous possible modifications to this invention. Accordingly, the scope of coverage provided by this patent is to be limited only by the language of the following claims and the prior art.

What is claimed is:

1. Canopy apparatus for use with a bed, comprising:

a frame suspended above said bed comprising four side members, each side member having an inner surface and an outer surface, each side member also having a slot formed in said inner surface thereof, said slots in said side members being mutually aligned forming a channel in said frame;

light generating means disposed within said frame; and a screen located beneath the light generating means, said screen having an outer edge portion supported by said channel, said screen having a plurality of openings formed therein, said screen being operative to at least partially restrict the passage of light from said light generating means to said bed, each of said openings being of a sufficient size and shape allowing light to pass therethrough in a manner which creates an appearance of a sky at night.

2. Canopy apparatus as set forth in claim 1, wherein:

said light generating means comprises at least one fluorescent lamp.

3. Canopy apparatus as set forth in claim 1, wherein:

said frame is generally rectangular.

4. Canopy apparatus as set forth in claim 1, further comprising:

a curtain suspended from said frame and extending to said bed, operative to restrict an inward passage of extraneous light to said bed.

5. Canopy apparatus as set forth in claim 1, further comprising:

a cover member supported by said frame above said screen, operative to prevent light from said light generating means from escaping through the cover member.

6. Canopy apparatus as set forth in claim 1, further comprising:

switch means operatively connected to said light generating means for selectively controlling said light generating means.

7. Canopy apparatus as set forth in claim 1, further comprising:

means electrically connecting to the light generating means for automatically dimming the light generated by said light generating means.

8. Canopy apparatus as set forth in claim 1, wherein:

said openings comprise a plurality of apertures configured to create a general appearance of stars.

9. Canopy apparatus as set forth in claim 1, wherein: said openings comprise at least one aperture configured to create a general appearance of a moon.

10. Canopy apparatus for use with a bed, adapted to create a general appearance of a sky at night, comprising:

a rectangular frame suspended above said bed, said frame comprising a plurality of frame members;

at least one electric lamp disposed within said frame; and a removable screen located beneath the lamp, the screen being suspended by and connected to each of said frame members, said screen operative to at least partially restrict the passage of light from said electric lamp to said bed, said screen having formed therein a plurality of first openings, each of said openings being of a sufficient size and shape allowing a portion of the light from said electric lamp shinning through said screen and create an appearance of stars.

11. Canopy apparatus as set forth in claim 10, further comprising:

at least one second opening formed in said screen, said second opening being of a sufficient size and shape to create an appearance of a moon.

12. Canopy apparatus as set forth in claim 10, further comprising: a switch electrically connecting to said lamp for selectively controlling said electric lamp.

13. Canopy apparatus as set forth in claim 10, wherein: said electric lamp comprises at least one fluorescent bulb.

14. Canopy apparatus as set forth in claim 11, further comprising: an incandescent bulb disposed within said frame, operative to generate and project light through said second opening.

15. Canopy apparatus for use with a bed, adapted to create a visual image for a user reclining on the bed, comprising:

a plurality of frame members which cooperate to form a frame suspended above said bed;

at least one electric lamp disposed within said frame; and a removable and generally opaque screen suspended by and connected to each of said frame members beneath said electric lamp, said screen being operative to at least partially restrict the passage of light from said electric lamp to said bed, said screen having formed therein at least one opening allowing a portion of the light from said electric lamp to shine through said screen, said opening forming an image for the user when light from the lamp is shined through the opening.

16. Canopy apparatus as set forth in claim 15, wherein:

said image comprises a star-lit sky.

* * * * *